United States Patent [19]

Woodward et al.

[11] 4,392,965

[45] Jul. 12, 1983

[54] LAUNDRY SOFTENER ANTISTATIC COMPOSITION

[76] Inventors: Fred E. Woodward, 200 Churchill Rd., West Palm Beach, Fla. 33405; Alice P. Hudson, 728 W. Kalmia Dr., Lake Park, Fla. 33403

[21] Appl. No.: 320,169

[22] Filed: Nov. 12, 1981

[51] Int. Cl.[3] ..... D06M 13/46; C11D 1/52; C11D 3/26; C11D 3/28

[52] U.S. Cl. ..... 252/8.8; 252/117; 252/542; 252/547; 8/137

[58] Field of Search ..... 252/8.8; 8/137

[56] References Cited

U.S. PATENT DOCUMENTS

| | | | |
|---|---|---|---|
| 3,223,718 | 12/1965 | Scherr et al. | 252/8.8 |
| 3,345,300 | 10/1967 | Speel | 252/547 |
| 3,625,891 | 12/1971 | Waldman et al. | 252/102 |
| 3,632,396 | 1/1972 | Perez-Zamora | 252/8.6 |
| 3,703,480 | 11/1972 | Grand et al. | 252/8.75 |
| 3,920,563 | 11/1975 | Wixon | 252/8.75 |
| 4,058,489 | 11/1977 | Hellsten | 252/8.75 |
| 4,173,539 | 11/1979 | Rule et al. | 252/8.8 |
| 4,184,970 | 1/1980 | Draper | 252/8.6 |

FOREIGN PATENT DOCUMENTS

| | | | |
|---|---|---|---|
| 7135 | 1/1980 | European Pat. Off. | 252/8.8 |

*Primary Examiner*—Maria P. Tungol

[57] ABSTRACT

Softener-antistatic compositions which are effective when added to a laundry wash cycle are water insoluble organic salts of a corboxylate anion containing a hydrocarbyl moiety with at least 10 carbon atoms and a quaternary ammonium cation containing two hydrocarbyl moieties with at least 12 carbon atoms each.

13 Claims, No Drawings

LAUNDRY SOFTENER ANTISTATIC COMPOSITION

FIELD OF THE INVENTION

This invention relates to improved softener-antistatic compositions effective when added to the laundry wash cycle which are water insoluble organic salts of a carboxylate anion containing a hydrocarbyl moiety with at least 10 carbon atoms and a quaternary ammonium cation containing 2 hydrocarbyl moieties with at least 12 carbon atoms each.

The quality of softness of laundered fabric as used herein is well defined in the art and refers to the quality of a treated fabric whereby its texture is smooth, pliable, and fluffy. The use of modern heavy duty laundry detergents tends to leave laundered clothes with an undesirable harshness due partly to the deposition of Ca and Mg carbonates, phosphates, etc., on the clothes. It is an object of this invention to provide a composition that will restore a soft pliable texture to laundered clothes.

Another problem encountered in laundering clothes, particularly if a mechanical dryer is used is that of static cling, which is defined in the art as the tendency of laundered and dried fabric, especially synthetic fabric such as nylon and polyester, to cling to itself and to the walls of the dryer due to the buildup of static electrical charges. When the fabric possesses static electrical charges it also tends to attract lint and dust and furthermore is uncomfortable to wear. It is an object of this invention to provide a composition which will dissipate the static charge on laundered and dried fabric.

Quaternary ammonium salts containing fatty alkyl groups have traditionally been used in household laundry softeners because they are substantive to the laundered fabric and provide both softening and control of static cling. However, they are incompatible with anionic detergents which severely restricts their use in the wash cycle. Their use in the rinse cycle necessitates an extra trip to the washing machine to add the softener at the appropriate time. It is an object of this invention to provide a softener antistatic composition which is compatible with anionic surfactants and thus can be added with or incorporated into a laundry detergent.

DESCRIPTION OF THE PRIOR ART

Many methods have been used to render quaternary ammonium softener compositions compatible with detergents containing anionic surfactants in the laundry wash cycle.

U.S. Pat. No. 4,184,970 discloses a wash cycle laundry softener composition in which particles or prills containing a quaternary ammonium salt were sprayed with a solution of an "anionic complexing component", which can be a fatty acid soap. Optionally, the particles or prills and the complexing component can be admixed as solids and sprayed with water. This procedure, however only partially complexes the quaternary ammonium salt, and the presence of the counterions from the two components causes the particles to disperse to an undesirable extent in the wash water. Also, since these prills are not homogeneous, their effectiveness depends on maintaining the physical integrity of the particle throughout the wash cycle. It is a further object of this invention to provide a homogeneous composition which because of its homogeneity does not depend on maintaining the physical structure of the original particle to be effective.

U.S. Pat. No. 3,704,480 discloses the use of aminopolyureylene resins mixed with quaternary ammonium salts to form a detergent compatible softener. U.S. Pat. No. 3,625,891 discloses certain mixtures of quaternary ammonium salts which are detergent compatible.

Surfactant quaternary ammonium salts and surfactant carboxylic acids and their salts have combined in various ways in softener compositions. U.S. Pat. No. 4,184,970 is described above. U.S. Pat. No. 3,632,396 discloses layers of a quaternary ammonium salt and a fatty acid on a substrate, the composition being useful as a dryer applied fabric softener. No complexing is implied or expected since the fatty acid is not neutralized. U.S. Pat. Nos. 3,703,480 and 3,625,891 described above disclose the use of "compatibilized" quaternary ammonium salts with detergents which contain anionic surfactants including fatty acid soaps. The object of these patents is to circumvent the interaction of the cationic and anionic components. U.S. Pat. No. 3,345,300 discloses a liquid softener-detergent composition which is a mixture of a surfactant containing both a polyethylene oxide moiety and a carboxylate salt with a quaternary ammonium salt. These products are soluble. U.S. Pat. No. 4,058,489 discloses detergent softener compositions which contain mixtures of anionic surfactants, including fatty acids, and cationic surfactants in molar ratios of anionic surfactant to cationic surfactant of from 0.6 to 1 to 0.9 to 1, together with nonionic and amphoteric surfactants to render the compositions dispersible. U.S. Pat. No. 4,173,439 discloses rinse cycle softener compositions which are dispersed complexes of quaternary ammonium salts with only one fatty alkyl group, and anionic surfactants, including fatty acid soaps, in rations from 1.1:1 to 5:1. The excess quaternary ammonium salt in these compositions renders them incompatible with anionic detergents and unsuited to the present invention.

We have now found that by forming an insoluble organic salt of certain carboxylate anions and quaternary ammonium cations herein disclosed, together with removing the counter ion salt and the water used as solvent by methods herein disclosed we obtain softener antistatic compositions with surprising advantages.

DETAILED DESCRIPTION OF THE INVENTION

This invention relates to improved softener antistatic compositions which are insoluble organic salts of carboxylate anions and quaternary ammonium cations of the structures

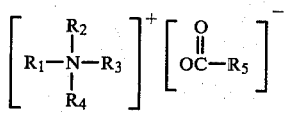

i.

wherein $R_1$ and $R_2$ are straight or branched chain alkyl or alkenyl containing 12 to 22 carbon atoms and preferably 16 to 20 carbon atoms and may be the same or different, and $R_3$ and $R_4$ are methyl, ethyl, or propyl; $R_5$ is (a) straight or branched chain alkyl or alkenyl containing 10 to 22 carbon atoms and preferrably contains 16 to 20 carbon atoms and is most preferrably straight chain alkyl, or (b) $CH_3(CH_2)_nCH(OH)-(CH_2)_m-$ wherein n+m is about 7 to 19 and preferrably 11 to 17, or (c) $R_6-Y-C(=O)-Z-$ wherein $R_6$ is straight or branched chain alkyl or alkenyl containing 10 to 26 carbon atoms and preferrably 16 to 20 carbon atoms; Y is O, NH, or S, and Z is —CH=CH—, —$CH_2$—$CH_2$—,

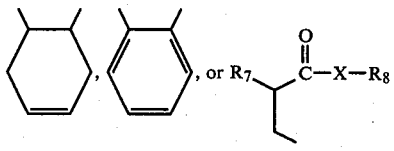

wherein X is O or NH, $R_7$ is straight or branched chain alkenyl or alkyl containing 8 to 18 carbon atoms, and $R_8$ is straight or branched chain alkyl or alkenyl containing 10 to 22 carbon atoms; or ii.

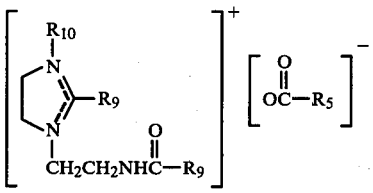

wherein $R_9$ is straight or branched chain alkyl or alkenyl containing 11 to 21 carbon atoms, and preferrably 15 to 19 carbon atoms; $R_{10}$ is methyl, ethyl, or propyl; and $R_5$ is as described above.

Examples of suitable carboxylate anions include

Stearate
Palmitate
Myristate
Arachidate
Behenate
Laurate
Decanoate
Hydroxystearate
Oleate
Elaidate

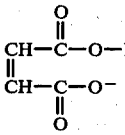

CH—C(=O)—O—R, R is a mixture of $C_{16}$ to $C_{20}$ alkyl

-continued

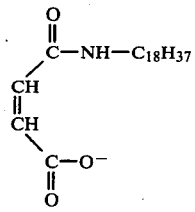

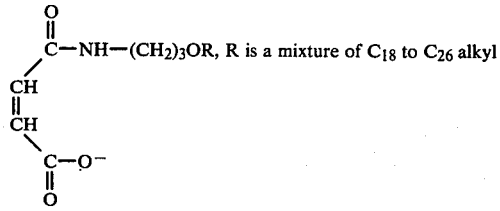

C—NH—$(CH_2)_3$OR, R is a mixture of $C_{18}$ to $C_{26}$ alkyl

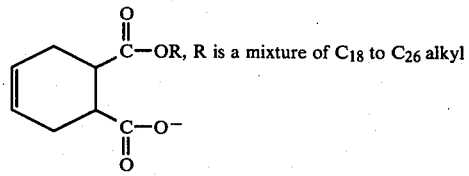

C—OR, R is a mixture of $C_{18}$ to $C_{26}$ alkyl

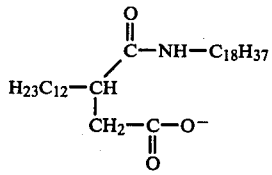

Preferred carboxylate anions are those which form di-higher alkyl quaternary ammonium salts which can be put in the form of a dry powder. Most preferred are the saturated aliphatic carboxylates containing 16 to 22 carbon atoms and mixtures thereof.

Examples of suitable quaternary ammonium ions include

Distearyldimethylammonium
Dihydrogenated tallow dimethyl ammonium
Ditallow dimethyl ammonium
Dilauryldimethyl ammonium

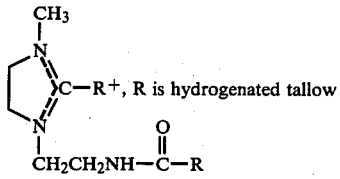

C—$R^+$, R is hydrogenated tallow

Dicocodimethyl ammonium

Preferred quaternary ammonium cations are those which form carboxylate salts which can be put in the form of a dry powder. Most preferred are di $C_{16}$-$C_{20}$ saturated alkyl dimethyl ammonium ions and mixtures thereof.

Another aspect of this invention is to the process for preparing laundry softener-antistatic compositions which are insoluble organic salts described above. The process consists essentially of (i) intimately mixing, in any order, from about 50 to about 90 parts of water with about 10 to 50 parts of a. a salt of the carboxylate anion and a counterion which is substantially ionized in water, and b. a salt of the quaternary ammonium cation and a counterion which is substantially ionized in water, taken together, the molar ratio of a to b being from about 0.8 to 1.2, and preferrably about 1:1, (ii) allowing the mixture to stand at a sufficient temperature and for a sufficient period of time such that the insoluble ion pair of the carboxylate anion and the quaternary ammonium cation separates from the water phase in a form that is no more than 60% water by weight, and contains no more than about 1 mole of the counterion salt per 4 moles of the insoluble ion pair of the carboxylate anion and the quaternary ammonium cation, (iii) evaporating the water from the carboxylate-quaternary ammonium ion pair until it contains less than about 25% water and preferrably less than about 10% water.

Suitable counterions for the carboxylate anion include, but are not limited to, $Na^+$, $K^+$, $Li^+$, $NH_4^+$, and substituted ammonium.

Suitable counterions for the quaternary ammonium cation include, but are not limited to, $Cl^-$, $Br^-$, $I^-$, $CH_3SO_4^-$, and $C_2H_5SO_4^-$.

A preferred process is to mix the quaternary ammonium salt with the carboxylic acid and warm to a temperature above the melting points of both components to effect mixing. This mixture is then added with vigorous stirring to a water solution of the hydroxide of the counter-cation heated to about the same temperature as that of the carboxylic acid-quaternary ammonium salt mixture. An organic phase containing less than about 60% water and preferrably less than 50% water is separated from the water phase containing greater than 75% of the theoretical amount of counterion salt. Most of the remaining water is evaporated from the organic phase using a minimum of heating. The final product contains less than about 25% water, and preferrably contains less than about 10% water.

The dried product is put into a form suitable for adding to a laundry wash cycle by methods known in the art. Hard, non-tacky solids are readily ground to particles preferrably less than about 500 microns in diameter. Paste or liquid products can be intimately mixed with high surface area solids such as kaolin clays, silica, soda ash, zeolite, smectite clays, etc., to form free-flowing powders.

The compositions of this invention effect good static protection and softening with all types of laundry detergents in common use. They are effective in built powders based on polyphosphates, NTA, or sodium carbonate, and containing nonionic, anionic, and amphoteric surfactants. They can either be incorporated into the powder or added separately to the washing machine. They are also effective when added with built or unbuilt liquid detergents containing nonionic, anionic, or amphoteric surfactants.

EXAMPLE I 26.5 g (0.10 mole) of eutectic stearic-palmitic acid (hereafter called stearic acid) was mixed with 75.9 g (0.10 mole) of a 75% dispersion of dihydrogenated tallow dimethyl ammonium chloride in alcohol, and the mixture was heated to 65° C. 4.0g (0.10 mole) of sodium hydroxide was dissolved in 150 ml of water and heated to 65° C. The fatty acid-quaternary salt mixture was added to the sodium hydroxide solution with vigorous stirring. A gelled organic phase separated from a clear water phase in about 30 seconds. Mixing was continued for 30 minutes at 65°-70° C. until the pH of the water phase was about 9. The water phase was decanted and the gel washed with 50 ml water at 65-70° C. The gel weighed 140 g, or was about 57% product, 43% water. The gel was spread into a thin layer and the water evaporated by passing a stream of air at about 40° C. over it. When the water content was about 7% the product was hard and non tacky and could be ground to a fine, free-flowing powder in a Waring Blender. The powder had a melting point of about 85° C.

Alternatively, the sodium salt of stearic acid was formed by adding the stearic acid to the sodium hydroxide solution at 70°, and the molten alcohol solution of the quaternary ammonium salt was added to the hot sodium stearate solution. A gel which contained 40 to 45% water separated as in the previous procedure, and the final products of the two methods were identical.

A less preferred method is to mix the quaternary ammonium salt with the sodium hydroxide solution and add the stearic acid, because the quaternary ammonium salt may decompose somewhat under hot, alkaline conditions, producing a product with objectionable odor.

Another less preferred method is to prepare an emulsion of the quaternary ammonium salt, stearic acid and water, and add the sodium hydroxide, because the initial emulsion has an objectionably high viscosity which creates mixing problems in a plant process.

These procedures also gave identical products. The product was tested as a wash cycle softener-antistat under the following conditions:

Detergent: 100 g of a powdered detergent containing 6.1% P and nonionic and anionic surfactants/20 gal. water.

Softener level: 6 g/20 gal. water

Cloth load: 5.4 lb. of a mixed laod containing 45 wt % synthetic (nylon, acrylic and polyester), 45 wt % permanent press (dacron-cotton blend) and 10% cotton terry cloth.

Wash temperature: 40-45° C.

Rinse temperature: Ambient

The clothes were dried in an electric dryer for 30 minutes, including a 5 minute cool-down cycle.

Under these conditions the product of this example eliminated static completely and produced excellent softening. At a level of 4.5 g of softener-antistat, static was just detectable by a trained observer and the hand was still very good.

EXAMPLE 2

By the first procedure of Example 1 the following organic salts were prepared:

A.

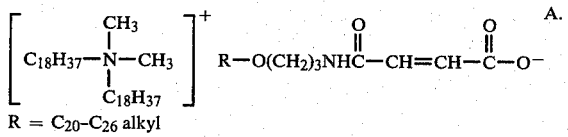

R = $C_{20}$-$C_{26}$ alkyl

B.

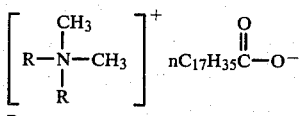

R = coco

-continued

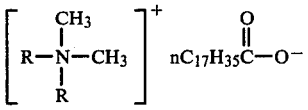

R = $C_{12}$–$C_{16}$ alkyl, $C_{15}$ ave.

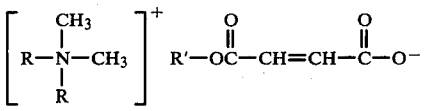

R = hydrogenated tallow, R′ = $C_{20}$–$C_{26}$ alkyl

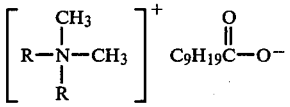

R = hydrogenated tallow

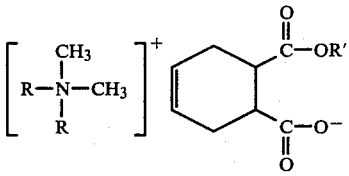

R = hydrogenated tallow, R′ = $C_{20}$–$C_{26}$ alkyl

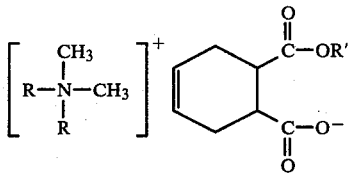

R = $C_{12}$–$C_{16}$ alkyl, $C_{15}$ ave., R′ = $C_{20}$–$C_{26}$ alkyl

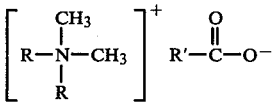

R = hydrogenated tallow, R′ = $C_{19}$–$C_{21}$ alkyl

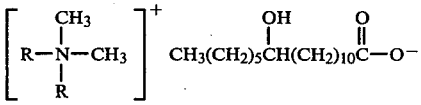

R = hydrogenated tallow

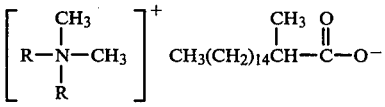

R = hydrogenated tallow

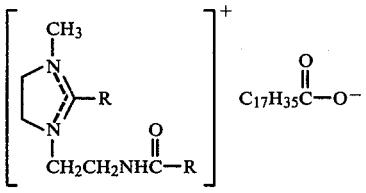

R = hydrogenated tallow

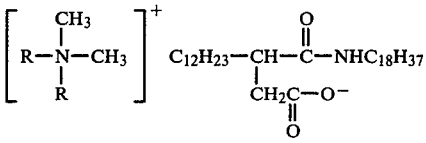

C. R = hydrogenated tallow

When they were tested under the conditions of Example 1 all showed no static or reduced static, and all showed an improvement in hand over the detergent alone.

D.

EXAMPLE 3

To demonstrate the advantages of (1) forming the ion pair, (2) removing the counterion salt, and (3) removing the water, the following compositions were prepared.

E. A. 26.5 g (0.10 mole) of stearic acid and 75.9 g (0.10 mole) of a 75% dihydrogenated tallow dimethyl ammonium chloride dispersion in alcohol were melted and mixed at 65°. The alcohol was evaporated by passing a current of air at 40 to 45° over a thin layer of the mixture. The resulting hard waxy solid was ground to a fine non-tacky powder.

F. B. 26.5 g (0.10 mole) of stearic acid and 75.9 g (0.10 mole) of a 75% dihydrogenated tallow dimethyl ammonium chloride dispersion in alcohol were melted and mixed at 65°, and poured into 4 g (0.10 mole) of sodium hydroxide in 75 ml of water at 65°. After the gelled product formed, the mixture was allowed to cool to room temperature, at which point the gel could be broken into a suspension of fine particles upon mixing with high shear. The water was evaporated from this suspension by passing a current of air over a thin layer of the mixture. The resulting product was a non-tacky solid and could be ground to a fine powder. It contained 1 mole of counterion salt (NaCl) per mole of softener ion pair.

G. C. 26.5 g (0.10 mole) of stearic acid and 75.9 g (0.10 mole) of a 75% dihydrogenated tallow dimethyl ammonium chloride dispersion in alcohol were melted and mixed at 65°, and poured into 4 g (0.10 mole) of sodium hydroxide in 150 ml of water at 65°. The water was decanted from the gelled product which formed and the gelled product was washed with 50 g of water at 65° and decanted. Water at room temperature was added to the gel to a total weight of 266 g, which is 30% active softener. The gel was dispersed by mixing at high shear. The product was a thick suspension.

H. The product of Example 1 was compared with the products of Example 3 under the test conditions of Example 1. The results are shown in Table 1.

I.

TABLE 1

| | Static | Hand |
|---|---|---|
| Example 1 | None | Excellent |
| Example 3A | Trace | Very good |
| Example 3B | Little or No Reduction | Very good |
| Example 3C | Little or No Reduction | Fair |

J.

K.

EXAMPLE 4

To prepare useable products from ion pairs which are too soft to be flaked or powdered, such ion pairs were mixed with high surface area substances, thus, L. A. 10 g of the composition of Example 2 F was intimately mixed with 6 g of amorphous silica (surface area=300 M 2/g). The resulting mixture was a free-flowing powder.

B. 10 g of the composition of Example 2 K was intimately mixed with 7.3 g of amorphous silica (surface area=300 M 2/g). The resulting mixture was a free-flowing powder.

C. 10 g of the composition of Example 2 E was intimately mixed with 35 g of kaolinite. The resulting mixture was a free-flowing powder.

D. 10 g of the composition of Example 2 E was intimately mixed with 30 g of soda ash. The resulting mixture was a free-flowing powder.

The compositions A–D were tested according to the procedure of Example 1. All showed significant reduction in static from the detergent alone, and also hand improved over the detergent alone.

EXAMPLE 5

Attempts to separate insoluble ion pairs by the procedure of Example 1 from the following ions were unsuccessful in that no phase separation occurred.

| | Anion | Cation |
|---|---|---|
| A. | Stearate | Cocotrimethyl ammonium |
| B. | Stearate | Stearyltrimethyl ammonium |
| C. | Stearate | Hydrogenated tallow di-2-hydroxypropyl methyl ammonium |
| D. | 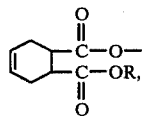 (R = $C_{18-26}$ alkyl) | Cocotrimethyl ammonium |

EXAMPLE 6

A. An ion pair was prepared from 29.2 g (0.11 mole) of stearic acid and 75.9 g (0.10 mole) of a 75% dispersion of dihydrogenated tallow dimethyl ammonium chloride in alcohol by the first procedure of Example 1. The gel which separated contained about 50% water.

B. A second ion pair was prepared from 26.5 g (0.10 mole) of stearic acid and 83.5 g (0.11 mole) of 75% dispersion of dihydrogenated tallow dimethyl ammonium chloride in alcohol by the first procedure of Example 1. The gel which separated contained about 48% water.

Both products were dried and ground to non-tacky powders and tested by the procedure of Example 1. Results are shown in Table 2.

TABLE 2

| | Static | Hand |
|---|---|---|
| Example 1 | None | Excellent |
| Example 6A | Trace | Fair |
| Example 6B | Little or No Reduction | Good |

It is understood that other adjuvents commonly added to laundry softeners can be incorporated into the compositions of this invention.

We claim:

1. A laundry softener-antistatic composition which is a water insoluble organic salt of carboxylate anions and quaternary ammonium cations of the structure

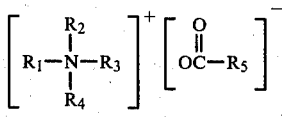

i.

wherein $R_1$ and $R_2$ are straight or branched chain alkyl or alkenyl containing 12 to 22 carbon atoms and may be the same or different, and $R_3$ and $R_4$ are methyl, ethyl, or propyl; $R_5$ is (a) straight or branched chain alkyl or alkenyl containing 10 to 22 carbon atoms, or

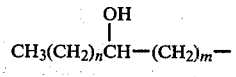

(b)

wherein n +m is about 7 to 19, or

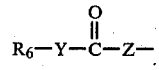

(c)

wherein $R_6$ is straight or branched chain alkyl or alkenyl containing 10 to 26 carbon atoms; Y is O, NH, or S, and Z is —CH=CH—, —CH-2—CH2—,

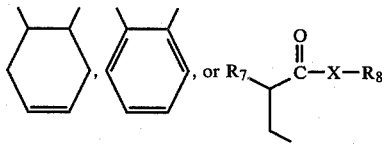

wherein X is O or NH, $R_7$ is straight or branched chain alkenyl or alkyl containing 8 to 18 carbon atoms, and $R_8$ is straight or branched chain alkyl or alkenyl containing 10 to 22 carbon atoms; or

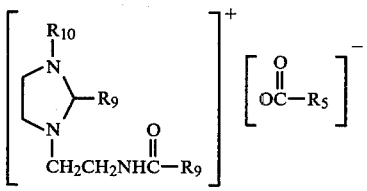

ii.

wherein $R_9$ is straight or branched chain alkyl or alkenyl containing 11 to 21 carbon atoms; $R_{10}$ is methyl, ethyl, or propyl; and $R_5$ is as described above.

2. The composition of claim 1 which contains a molar ratio of water insoluble carboxylate-quaternary ammonium salt to counterion salt of greater than about 4 to 1.

3. The composition of claim 2 which contains less than about 60% water.

4. The composition of claim 2 which contains no more than about 25% water.

5. The composition of claim 1 in which the carboxylate anion is $C_{16}$ to $C_{18}$ straight chain alkyl and the quaternary ammonium cation is di($C_{16}$–$C_{18}$ alky) dimethyl ammonium.

6. The composition of claim 1 in which the molar ratio of carboxylate anion to quaternary ammonium cation is from about 0.9:1 to about 1.2:1.

7. The composition of claim 1 in which the molar ratio of carboxylate anion to quaternary ammonium cation is about 1 to 1.

8. The composition of claim 1 in admixture with from about 10% to about 75% of one or more substances taken from the group consisting of:

a. Kaolin clays
b. Smectic clays
c. Amorphous silica
d. Zeolites.

9. The process of preparing the composition of claim 1 which consists essentially of (i) intimately mixing in any order from about 50 to 90 parts of water with about 10 to 50 parts of
  a. a salt of the carboxylate anion and a counter ion which is substantially ionized in water, and
  b. a salt of the quaternary ammonium cation and a counter ion which is substantially ionized in water,
  taken together, the molar ratio of a to b being from about 0.8 to 1.2,
(ii) allowing the mixture to stand at a sufficient temperature and for a sufficient period of time such that the insoluble ion pair of the carboxylate anion and the quaternary ammonium cation separates from the water phase in a form that is no more than about 60% water by weight, and contains no more than about 1 mole of the salt of the counter ions per 4 moles of the insoluble salt of the carboxylate anion and the quaternary ammonium cation, and
(iii) evaporating the water from the carboxylate-quaternary ammonium salt until it contains less than about 25% water.

10. The composition which is the product from the process of claim 9.

11. A composition consisting of from about 90 to 100% of the insoluble organic salt of claim 1, and from about 0 to 10% water, which is in the physical form of particles of less than 500 microns in diameter.

12. A detergent softener-antistat which consists essentially of from about 1% to about 25% of the composition of claim 11, and from about 75% to 99% of a powdered laundry detergent containing anionic, nonionic, or amphoteric surfactants or mixtures thereof and builder salts.

13. In the process of washing clothes and then drying the clothes in a mechanical dryer the improvement which comprises adding before or during the washing step, the composition of claim 1.

* * * * *